US005418558A

United States Patent [19]

Hock et al.

[11] Patent Number: 5,418,558

[45] Date of Patent: May 23, 1995

[54] DETERMINING THE OPERATING ENERGY OF A THERMAL INK JET PRINTHEAD USING AN ONBOARD THERMAL SENSE RESISTOR

[75] Inventors: Scott W. Hock, San Diego; David A. Johnson, Bonsall, both of Calif.; Niels J. Nielsen, Corvallis, Oreg.

[73] Assignee: Hewlett-Packard Company, Palo Alto, Calif.

[21] Appl. No.: 57,943

[22] Filed: May 3, 1993

[51] Int. Cl.[6] ..... B41J 2/05

[52] U.S. Cl. ..... 347/14; 347/19; 347/57

[58] Field of Search ..... 347/19, 14, 17, 56, 347/57, 67

[56] References Cited

U.S. PATENT DOCUMENTS

| | | | |
|---|---|---|---|
| 4,860,034 | 8/1989 | Watanabe | 347/14 |
| 4,872,028 | 10/1989 | Lloyd | 347/14 |
| 5,023,626 | 6/1991 | Kawamura | 347/14 |
| 5,036,337 | 7/1991 | Rezanka | 347/14 |
| 5,223,853 | 6/1993 | Wysocki | 347/14 |

*Primary Examiner*—Joseph W. Hartary
*Attorney, Agent, or Firm*—Dennis G. Stenstrom

[57] ABSTRACT

A method for operating a thermal ink jet printer including a printhead having ink firing heater resistors responsive to pulses provided to the printhead. A sequence of pulse bursts of respective increasing or decreasing pulse energies that span a predetermined pulse energy range is applied to the printhead, each pulse burst comprised of a plurality of pulses having a pulse energy that is associated with such pulse burst and is constant for all pulses in such burst, and each burst having a sufficient number of pulses to allow the printhead to achieve a steady state operating temperature at the pulse energy of the pulse burst. A steady state operating temperature sample is determined for each of the sequence of pulses bursts of different pulse energies to produce a set of temperature samples respectively associated with the increasing pulse energies, and a turn on pulse energy is determined from the temperature samples. The thermal ink jet printhead is then operated with a pulse energy that is greater than the turn on pulse energy and in a range that provides a desired print quality while avoiding premature failure of the heater resistors.

10 Claims, 4 Drawing Sheets

DETERMINING THE OPERATING ENERGY OF A THERMAL INK JET PRINTHEAD USING AN ONBOARD THERMAL SENSE RESISTOR

BACKGROUND OF THE INVENTION

The subject invention relates generally to thermal ink jet printers, and is directed more particularly to a technique for determining the turn on energy of a thermal ink jet printhead while the printhead is installed in a printer.

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The printheads of thermal ink jet printers are commonly implemented as replaceable printhead cartridges which typically include one or more ink reservoirs and an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers. Each heater resistor causes an ink drop to be fired from its associated nozzle in response to an electrical pulse of sufficient energy.

A thermal ink jet printhead requires a certain minimum energy to fire ink drops of the proper volume (herein called the turn on energy). Turn on energy can be different for different printhead designs, and in fact varies among different samples of a given printhead design as a result of manufacturing tolerances. As a result, thermal ink jet printers are configured to provide a fixed ink firing energy that is greater than the expected lowest turn on energy for the printhead cartridges it can accommodate.

A consideration with utilizing a fixed ink firing energy is that firing energies excessively greater than the actual turn on energy of a particular printhead cartridge result in a shorter operating lifetime for the heater resistors and degraded print quality. Another consideration with utilizing a fixed ink firing energy is the inability to utilize newly developed or revised printheads that have ink firing energy requirements that are different from those for which existing thermal ink jet printers have been configured.

It would be possible for a printhead cartridge manufacturer to test each printhead for turn on energy prior to distribution, but known techniques for determining turn-on energy (e.g., by detecting ink drop volume or ink drop velocity) are complex and time consuming, and are not readily adapted to production manufacturing. Moreover, the turn on energy of a printhead might not remain constant throughout its useful life.

SUMMARY OF THE INVENTION

It would therefore be an advantage to provide a thermal ink jet printer that determines the turn on energy of a thermal ink jet printhead while the printhead is installed in the printer.

The foregoing and other advantages are provided by the invention in a method of operating a thermal ink jet printhead that includes the steps of (A) applying to the printhead a sequence of pulse bursts of respective increasing or decreasing pulse voltages that span a predetermined pulse voltage range, each pulse burst having a predetermined pulse width and pulse frequency and being comprised of a plurality of pulses having a pulse voltage that is associated with such pulse burst and is constant for all pulses in such burst, and each burst having a sufficient number of pulses to allow the printhead to achieve a steady state operating temperature at the pulse energy of the pulse burst, (B) sampling a steady state operating temperature of the printhead for each of the pulses bursts of different voltages to produce a set of temperature samples respectively associated with the increasing pulse voltages, (C) determining a turn on pulse voltage from the temperature samples, and (D) operating the thermal ink jet printhead with a pulse energy that is greater than the turn on pulse energy provided by the turn on pulse voltage and in a range that provides a desired print quality while avoiding premature failure of the heater resistors.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
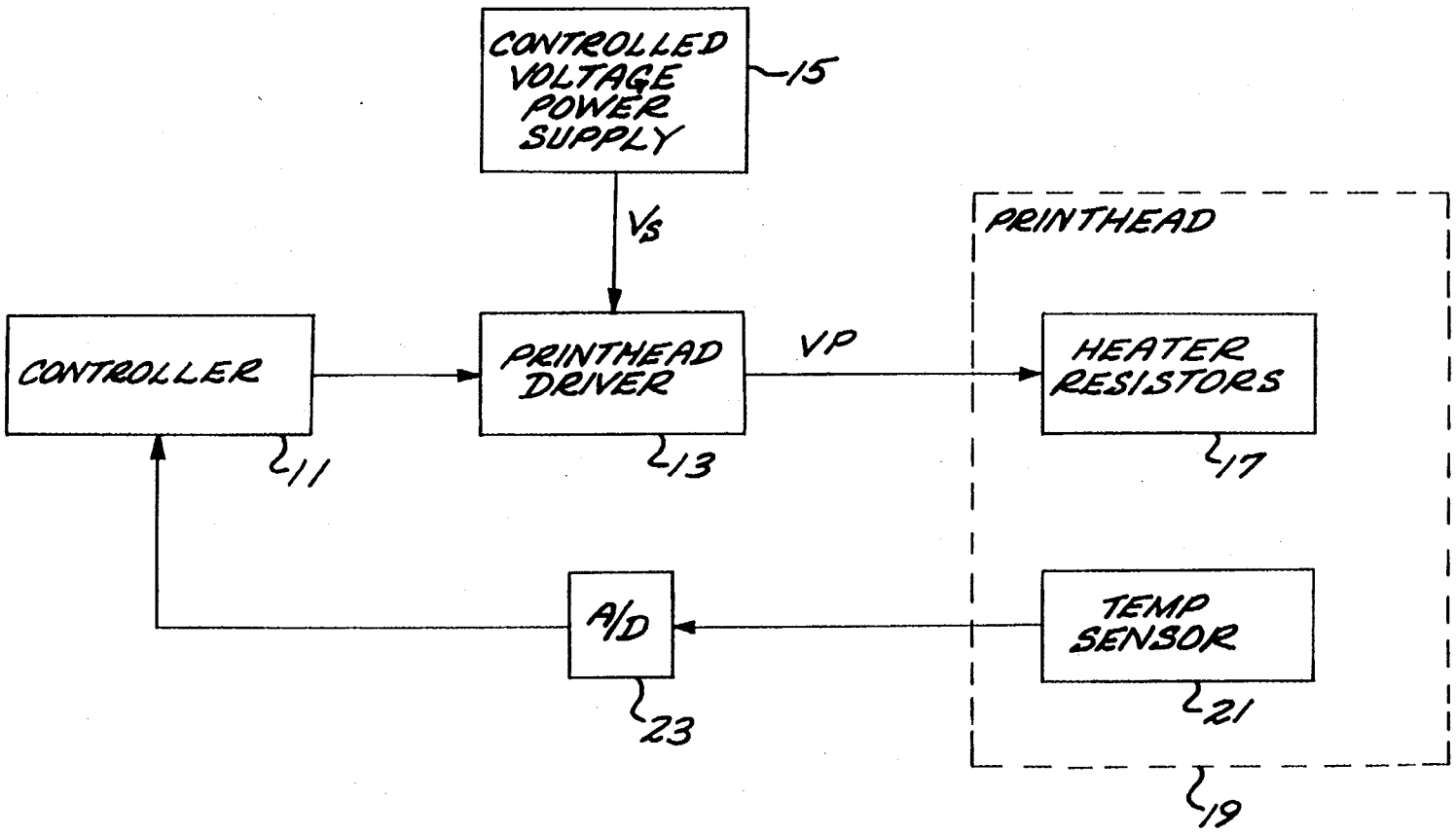
FIG. 1 is a schematic block diagram of the thermal ink jet components for implementing the invention.

In the following detailed description and in the several figures of the drawing, like elements are identified with like reference numerals.

Referring now to FIG. 1, shown therein is a simplified block diagram of a thermal ink jet printer that employs the techniques of the invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage VP to a thin film integrated circuit thermal ink jet printhead 19 that includes thin film ink drop firing heater resistors 17. The voltage pulses are VP are typically applied to contact pads that are connected by conductive traces to the heater resistors, and therefore the pulse voltage received by an ink firing resistor is typically less than the pulse voltage VP at the printhead contact pads. Since the actual voltage across a heater resistor cannot be readily measured, turn on energy for a heater resistor as described herein will be with reference to the voltage applied to the contact pads of the printhead cartridge associated with the heater resistor. The resistance associated with a heater resistor will be expressed in terms of pad to pad resistance of a heater resistor and is interconnect circuitry (i.e., the resistance between the printhead contact pads associated with a heater resistor).

The relation between the pulse voltage VP and the supply voltage $V_s$, will depend on the characteristics of the driver circuitry. For example, the printhead driver circuit can be modelled as a substantially constant voltage drop $V_d$, and for such implementation the pulse voltage VP is substantially equal to the supply voltage $V_s$ reduced by the voltage drop $V_d$ of the driver circuit:

$$VP = V_s - V_d \quad \text{(Equation 1)}$$

If the printhead driver is better modelled as having a resistance $R_d$, then the pulse voltage is expressed as:

$$VP = V_s(R_p/(R_d + R_p)) \quad \text{(Equation 2)}$$

wherein $R_p$ is the pad to pad resistance associated with a heater resistor.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage VP that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors.

As with known controller structures, the controller 11 would typically provide other functions such as control of the printhead carriage (not shown) and control of movement of the print media.

The integrated circuit printhead of the thermal ink jet printer of FIG. 1 also includes a temperature sensor 23, comprising a thermal sense resistor for example, located in the proximity of some of the heater resistors, and provides an analog electrical signal representative of the temperature of the integrated circuit printhead. The analog output of the temperature sensor 23 is provided to an analog-to-digital (A/D) converter 25 which provides a digital output to the controller 11. The digital output of the A/D converter 25 comprises quantized samples of the analog output of the temperature sensor 23. The output of the A/D converter is indicative of the temperature detected by the temperature sensor.

Figure 2:
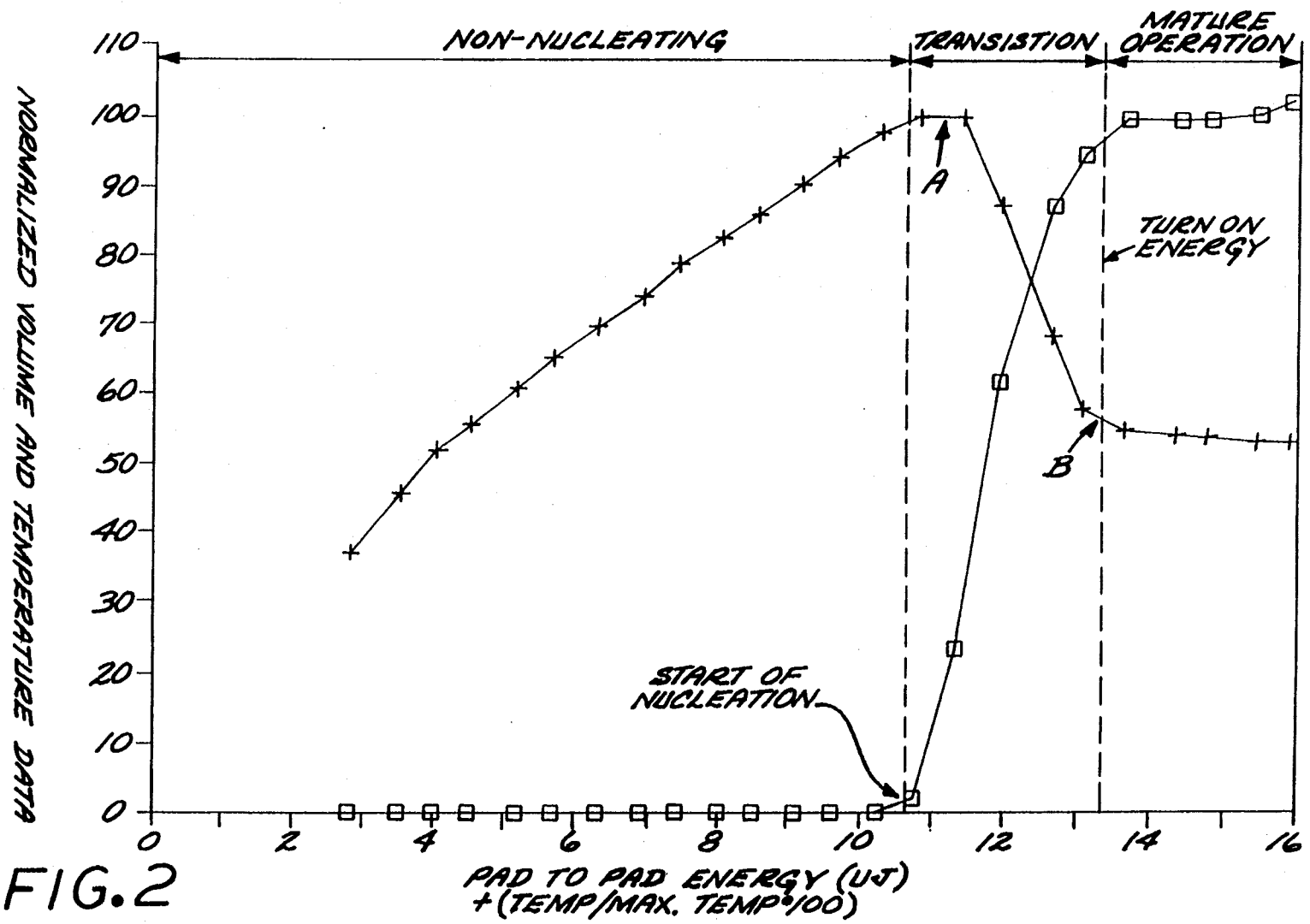
FIG. 2 is a graph showing printhead temperature and ink drop volume plotted against energy applied to ink firing resistors of a printhead.

In accordance with the invention, the controller 11 determines a turn on pulse energy for the printhead 19 that is the minimum pulse energy at which a heater resistor produces an ink drop of the proper volume, wherein pulse energy refers to the amount of power provided by a voltage pulse; i.e., power multiplied by pulse width. FIG. 2 sets forth representative curves drawn through discrete normalized printhead temperature data and normalized ink drop volume data plotted against pulse energy applied to each of the heater resistors of a thermal ink jet printhead. The discrete printhead temperatures for the temperature curve are depicted by crosses (+) while discrete drop volumes utilized for the ink drop volume curve are depicted by hollow squares (□). The curves of FIG. 2 indicate three different phases of operation of a heater resistor. The first phase is a non-nucleating phase wherein the energy is insufficient to cause nucleation. In the non-nucleating phase printhead temperature increases with increasing pulse energy while ink drop volume remains at zero. The next phase is the transition phase wherein the pulse energy is sufficient to cause ink drop forming nucleation, but the ink drops are not of the proper volume. In the transition phase the ink drop volume increases with increasing pulse energy while the printhead temperature decreases with increasing pulse energy. The decrease in printhead temperature is due to transfer of increasing amounts of heat from the printhead by ink drops of increasing drop volume. The next phase is the mature phase wherein drop volume is relatively stable and temperature increases with increasing pulse energy. FIG. 2 shows only the lower energy portion of the mature phase, and it should be appreciated that printhead temperature increases with increased pulse energy since ink drop volume remains relatively constant in the mature phase. Turn on energy is defined to be the minimum pulse energy that produces mature ink drops. In other words, increasing pulse energy beyond the turn on energy does not increase drop volume.

The temperature curve shown in FIG. 2 includes 2 inflection points A and B, one between from the non-nucleating phase and the transition phase, and the other between the transition phase and the mature phase. Each inflection point is the point of maximum curvature of the temperature curve in a region where the slope of the fitted curve is reversing; i.e., changing from positive to negative, or changing from negative to positive. A point of maximum curvature is where the change in slope of the temperature curve is at a maximum. In particular, the inflection point A is in the region where the slope of the temperature curve is changing from positive to negative, while the inflection point B is in the region where the slope of the temperature curve is changing from negative to positive.

In accordance with the invention, a printhead is tested for its minimum turn on energy generally as follows. A series of temperature samples for different pulse energies is produced for the printhead being tested. The temperature samples are then analyzed, for example by computer processing, to find the inflection points A and B in the temperature data, wherein such inflection points can be between discrete temperature samples. The pulse energy corresponding to the inflection point B is selected as the turn on energy for the printhead tested, while the pulse energy corresponding to the inflection point A is compared to the turn on energy to determine whether the printhead is operating properly. If the difference between (a) the pulse energy corresponding to the inflection point B and (b) the pulse energy corresponding to the inflection point A is greater than a predetermined amount, the printhead being tested is considered as being bad due to poor nucleation. Such predetermined amount would be empirically determined for each printhead design.

If the printhead is determined to be operating properly, the printhead is operated at an energy that is greater than the measured turn on energy and within a range that insures proper print quality while avoiding premature failure of the heater resistors. If the difference of energies corresponding to the inflection points A and B indicates that the printhead is not operating properly, a failure report could be provided indicating that the printhead is bad, or it can be operated a nominal pulse energy.

The inflection points A and B, which are points of localized maximum curvature of a curve that is drawn or fitted through the temperature samples, are readily determined pursuant to conventional numerical techniques which may or may not involve actual curve fitting.

For example, the temperature data can be divided into three subgroups corresponding to the non-nucleating, transition, and mature phases. Respective best fit lines are determined for each of the temperature subgroups, for example by linear regression, and the energy corresponding to the intersection between the transition phase best fit line and the mature phase best fit line is selected as the turn on energy, while the energy corresponding to the intersection between the non-nucleating phase and the transition phase is compared with the turn on energy to determine if the printhead is operating properly. By way of specific illustrative example, the temperature samples can be separated into subgroups by examining the temperature data in the sequence of increasing pulse energy. The temperature data samples from the temperature data sample for the lowest energy through the temperature data sample immediately prior to the maximum temperature data sample are allocated to the first subgroup; the temperature data samples from the maximum temperature data sample through the data sample immediately prior to a minimum temperature data sample are allocated to the second subgroup, and the remaining temperature data samples are allocated to the third subgroup. Depending upon the particular temperature response of a printhead, the maximum and subsequent minimum temperature data samples and samples in the proximity thereof can be ignored for purposes of fitting lines to the three subgroups of temperature samples so as to fit the lines to linear portions of the temperature data.

As another example of determining the inflection points A and B, the temperature data for a printhead can be utilized to determine an equation for a best fit curve fitted to the temperature data that defines temperature as a function of energy. Then, the energy corresponding to the maximum curvature in the region of the negative to positive slope transition comprises the turn on energy, while the energy corresponding to the maximum curvature in the region of the positive to negative slope transition is compared with the turn on energy to determine if the printhead is operating properly.

As a further example of determining the inflection points A and B, the maximum temperature and a subsequent minimum temperature can be determined for an equation of a best fit curve that is fitted to the temperature data. The maximum temperature comprises the inflection point A while the subsequent minimum temperature corresponds to the inflection point B, and the energy corresponding to such subsequent minimum temperature comprises the turn on energy.

As yet another example of determining the inflection points A and B, depending on the particular shape of the temperature curve, the temperature data can be searched for a maximum and a subsequent minimum, wherein the energy corresponding to such minimum comprises the turn on energy.

Figure 3:
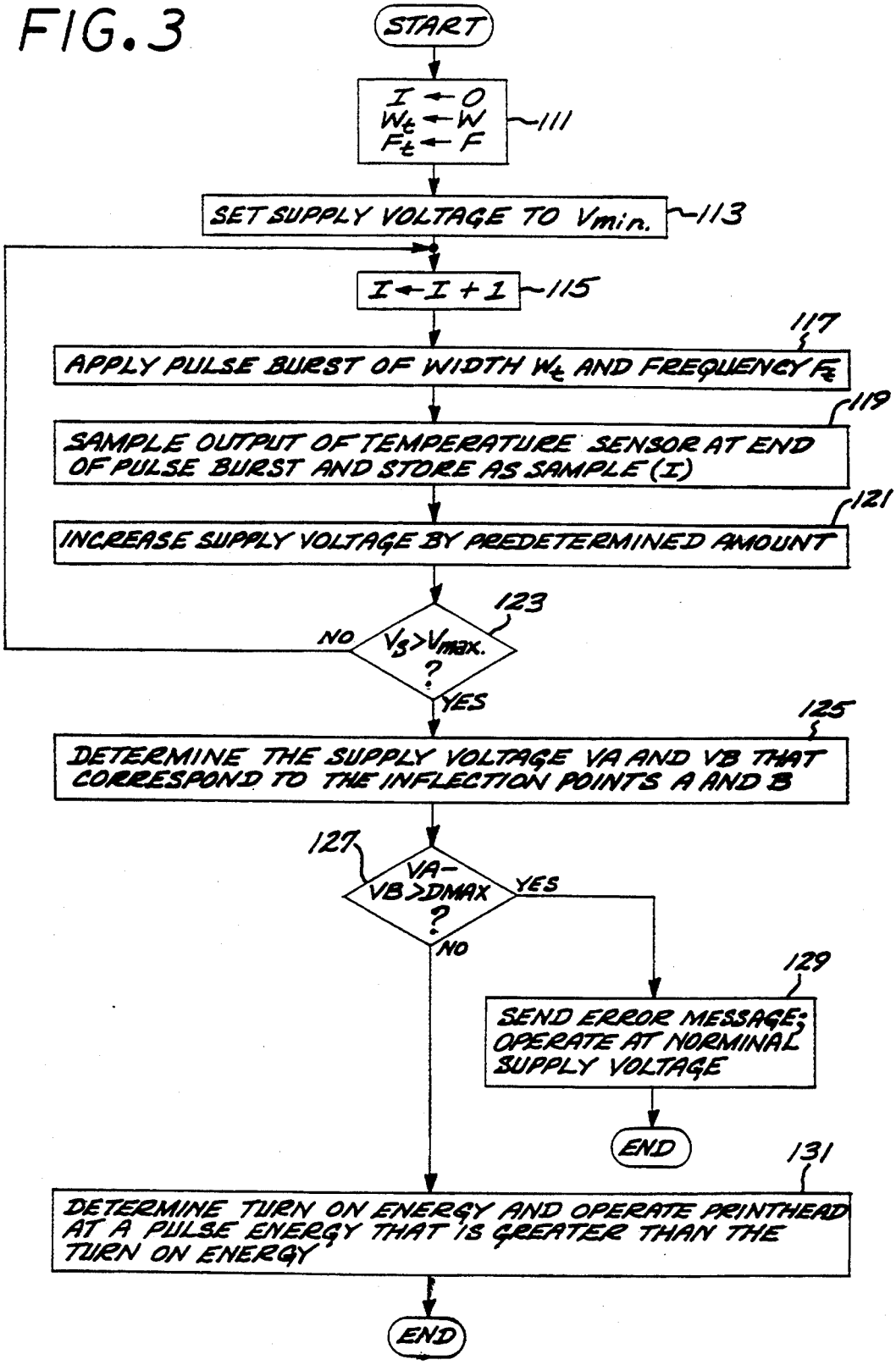
FIG. 3 is a flow diagram of a procedure for determining printhead turn on energy in accordance with the invention.

Referring now to FIG. 3, set forth therein is a flow diagram of a procedure in accordance with the invention for determining turn on energy in accordance with the invention. At 111 a sample count I is initialized to 0, a test pulse width $W_t$ is set to the fixed operating pulse width W utilized during normal operation, and a test pulse frequency $F_t$ is set to the fixed operating frequency F utilized during normal operation. At 113 the supply voltage is set to a predetermined minimum voltage $V_{min}$ that is determined to provide a pulse energy that is sufficiently low that the printhead would be operating in the non-nucleating phase. As used herein, pulse energy is power applied to an ink firing resistor multiplied by pulse width.

At 115, the sample count I is incremented by 1. At 117 a pulse burst of pulses of voltage $VP_r$, width $W_t$ and frequency $F_t$ applied to the printhead, wherein the voltage $VP_r$ is the pulse voltage resulting from the particular supply voltage, and wherein the duration of the pulse burst is sufficient to allow the printhead to reach its steady state operating temperature for the particular pulse energy of the pulses being applied.

At 119 the output of the temperature sensor is sampled at the end of the pulse burst, and the sample is stored as SAMPLE (I). At 121 the supply voltage is incremented by a predetermined amount, and at 123 a determination is made as to whether the supply voltage $V_s$ is greater than a predetermined maximum voltage $V_{max}$ which is selected to be greater than the supply voltage required to produce the highest expected turn on energy for the printhead. If no, control transfers to 115 to obtain another temperature sample.

If the determination at 123 is yes, the supply voltage $V_s$ is greater than the predetermined maximum supply voltage $V_{max}$, at 125 the supply voltages VA and VB corresponding to the inflection points A and B are determined. At 127 a determination is made as to whether the difference between supply voltages VB and VA is greater than a predetermined maximum DMAX. If yes, at 129 an error message is sent, and the printhead is operated pursuant to a nominal supply voltage. If the determination at 127 is no, at 131 a turn on energy TOE is determined from the supply voltage VB which is the turn on supply voltage, and the printhead is operated at an operating pulse energy that is greater than the measured turn on energy and within a range that insures proper print quality while avoiding premature failure of the heater resistors.

Pursuant to the procedure of FIG. 3, a series of pulses bursts of respective stepwise or incrementally increasing pulse energies are applied to the printhead being tested, wherein the pulse energies span a predetermined pulse energy range that allows the printhead to operate between the non-nucleating phase and the mature operation phase so that the inflection points A and B can be determined pursuant to analysis of the temperature samples. Each pulse burst is of sufficient duration to enable the printhead to reach a steady state operation temperature for the pulse energy of the pulse burst, and a steady state temperature sample is taken for each pulse energy. A turn on energy TOE is then determined from the temperature samples, and the printer is operated at a pulse energy that is greater than the turn on energy.

An operating supply voltage $V_{op}$ that provides a desired operating pulse energy OPE is readily determined as follows. Pulse energy is power times pulse width W, and power is voltage squared divided by resistance. Accordingly, the turn on energy TOE provided by the supply voltage VB can be expressed as:

$$TOE = VP_{turn\ on}^2 * W_t / R_p \quad \text{(Equation 3)}$$

wherein $W_t$ is the pulse width utilized in testing for the turn on supply voltage VB, $VP_{turn\ on}$ is the voltage of the pulses produced by the driver circuit pursuant to the turn on supply voltage VB, and $R_p$ is the pad to pad resistance associated with a heater resistor.

For the implementation wherein the driver circuit introduces a substantially constant voltage drop, turn on energy TOE can be expressed as follows from Equations 1 and 3:

$$TOE = (VB - V_d)^2 * W_t / R_p \quad \text{(Equation 4)}$$

wherein and $V_d$ is the voltage drop across the driver circuit.

An operating energy OPE is then selected, and the operating supply voltage $V_{op}$ required to provide the selected operating energy can be determined by expressing OPE in terms of the operating supply voltage similarly to Equation 4:

$$OPE = (V_{op} - V_d)^2 * W / R_p \quad \text{(Equation 5)}$$

wherein W is the operating pulse width. Solving Equation 5 for the operating supply voltage $V_{op}$ results in the following equation:

$$V_{op} = (R_p * OPE / W)^{\frac{1}{2}} - V_d \quad \text{(Equation 6)}$$

For the particular implementation wherein the driver circuit is better modelled as a resistor, turn on energy TOE can be expressed as follows from Equations 1 and 3:

$$TOE = (VB * R_p / (R_d + R_p))^2 * W_t / R_p \quad \text{(Equation 7)}$$

wherein $R_d$ is the resistance of the driver circuit, $W_t$ is the pulse width utilized in the determination of the turn on supply voltage VB, and $R_p$ is the pad to pad resistance associated with each of the heater resistors.

An operating energy OPE is then selected, and the operating supply voltage $V_{op}$ required to provide the selected operating energy can be determined by expressing OPE in terms of the required supply voltage similarly to Equation 7:

$$OPE = (V_{op} * R_p / (R_p + R_d) / R_p)] \quad \text{(Equation 8)}$$

wherein W is the operating pulse width. Solving Equation for the operating supply voltage $V_{op}$ results in the following equation:

$$V_{op} = (R_p * OPE / W)^{\frac{1}{2}} * [(R_p + R_d) / R_p)] \quad \text{(Equation 9)}$$

In evaluating the turn on energy TOE from the turn on supply voltage, and in determining a supply voltage that will provide a selected operating pulse energy, the pad to pad resistance $R_p$ associated with a heater resistor comprises a nominal value, for example, or a measured value representative of the resistance of a heater resistor to the extent the printhead includes circuitry for providing such a measured value.

Figure 4:
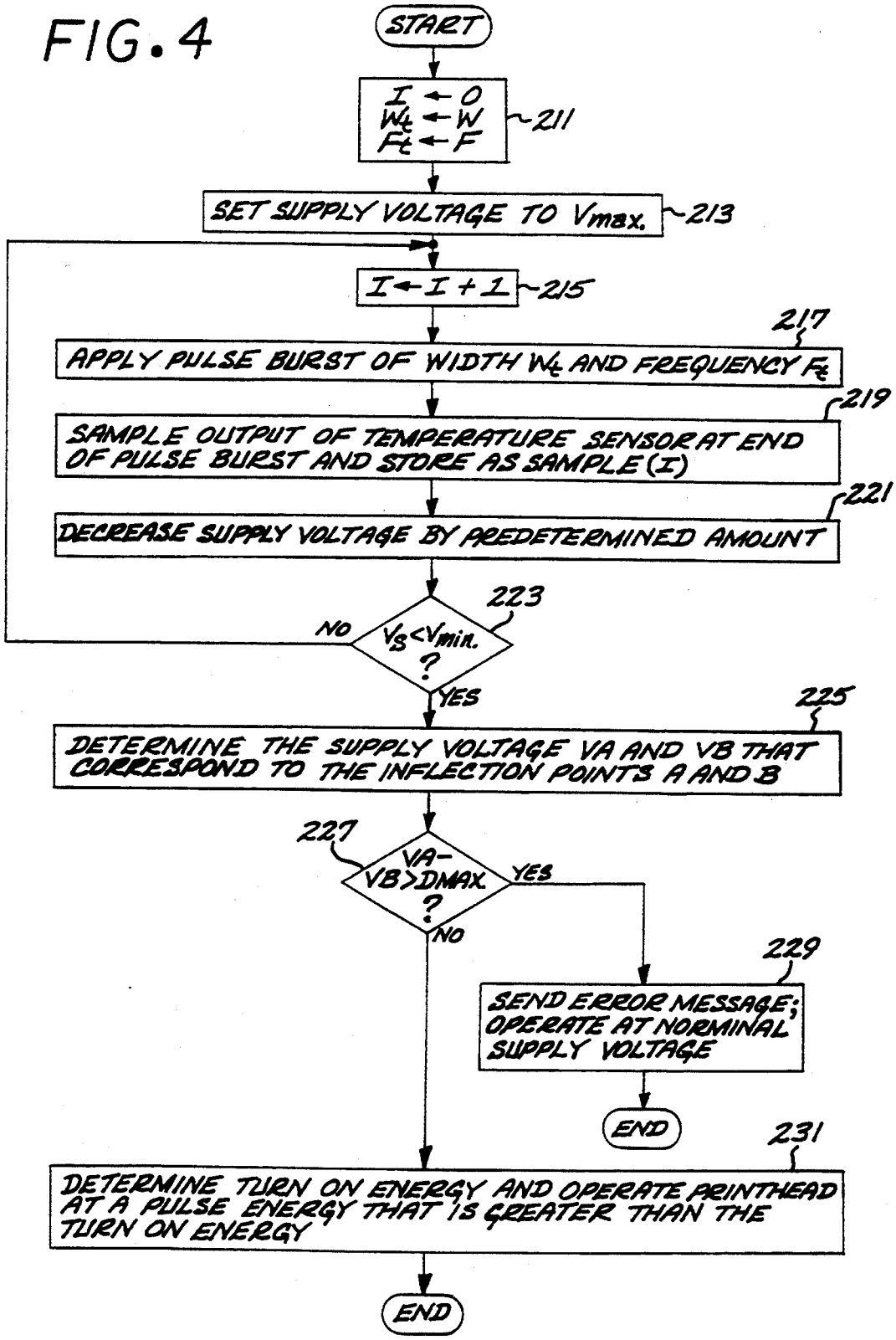
FIG. 4 is a flow diagram of a further procedure for determining printhead turn on energy in accordance with the invention.

Referring now to FIG. 4, set forth therein is a flow set forth therein is a flow diagram of a further procedure in accordance with the invention for determining turn on energy in accordance with the invention by determining temperature data samples pursuant to a series of respective stepwise or incrementally decreasing pulse energies applied to the printhead being tested. At 211 a sample count I is initialized to 0, a test pulse width $W_t$ is set to the fixed operating pulse width W utilized during normal operation, and a test pulse frequency $F_t$ is set to the fixed operating frequency F utilized during normal operation. At 213 the supply voltage is set to a predetermined maximum voltage $V_{max}$ that is selected to be greater than the supply voltage required to produce the highest expected turn on energy for the printhead. As used herein, pulse energy is power applied to an ink firing resistor multiplied by pulse width.

At 215, the sample count I is incremented by 1. At 117 a pulse burst of pulses of voltage $VP_r$, width $W_t$ and frequency $F_t$ applied to the printhead, wherein the voltage $VP_r$ is the pulse voltage resulting from the particular supply voltage, and wherein the duration of the pulse burst is sufficient to allow the printhead to reach its steady state operating temperature for the particular pulse energy of the pulses being applied.

At 219 the output of the temperature sensor is sampled at the end of the pulse burst, and the sample is stored as SAMPLE (I). At 221 the supply voltage is decremented by a predetermined amount, and at 223 a determination is made as to whether the supply voltage $V_s$ less than a predetermined maximum voltage $V_{min}$ which is selected to be sufficiently low such that the printhead would be operating in the non-nucleating phase pursuant to a supply voltage that is set to $V_{min}$. If no, control transfers to 215 to obtain another temperature sample.

If the determination at 223 is yes, the supply voltage $V_s$ is less than the predetermined minimum supply voltage $V_{min}$, at 225 the supply voltages VA and VB corresponding to the inflection points A and B are determined. At 227 a determination is made as to whether the difference between supply voltages VB and VA is greater than a predetermined maximum DMAX. If yes, at 229 an error message is sent, and the printhead is operated pursuant to a nominal supply voltage. If the determination at 227 is no, at 231 a turn on energy TOE is determined from the supply voltage VB which is the turn on supply voltage, and the printhead is operated at an operating pulse energy that is greater than the measured turn on energy and within a range that insures proper print quality while avoiding premature failure of the heater resistors.

The foregoing has been a disclosure of a thermal ink jet printer that advantageously determines a turn on energy of a thermal ink jet printhead while the printhead is installed in the printer and operates at a pulse energy that is based on the determined turn on energy. Pursuant to the invention, print quality and useful printhead life are optimized.

Although the foregoing has been a description and illustration of specific embodiments of the invention, various modifications and changes thereto can be made by persons skilled in the art without departing from the scope and spirit of the invention as defined by the following claims.

What is claimed is:

1. A method for operating a thermal ink jet printer including a printhead having ink firing resistors responsive to pulses provided to the printhead, the pulses having a voltage, a pulse width, and a pulse energy defined by the voltage and pulse width of a pulse, comprising the steps of:

(A) applying to the printhead a sequence of pulse bursts of respective increasing pulse energies that span a predetermined pulse energy range, each pulse burst comprised of a plurality of pulses having a pulse energy that is associated with such pulse burst and is constant for all pulses in such burst, and each burst having a sufficient number of pulses to allow the printhead to achieve a steady state operating temperature at the pulse energy of the pulse burst;

(B) sampling a steady state operating temperature of the printhead for each of the sequence of pulses bursts of different pulse energies to produce a set of temperature samples respectively associated with the increasing pulse energies;

(C) analyzing the temperature samples to determine a turn on pulse energy from the temperature samples; and (D) operating the thermal ink jet printhead with a pulse energy that is greater than the turn on pulse energy and in a range that provides a desired print quality while avoiding premature failure of the heater resistors.

2. The method of claim 1 wherein the step of analyzing the temperature samples to determine a turn on pulse energy comprises the step of determining a turn on pulse energy that corresponds to a maximum curvature of a temperature curve fitted to the temperature samples in a region of the temperature samples that changes from decreasing to increasing pursuant to increasing pulse energy.

3. The method of claim 1 wherein the step of analyzing the temperature samples to determine a turn on pulse energy includes the steps of:

(1) fitting a first linear regression line to temperature samples that are between a maximum temperature sample having a pulse energy associated therewith and a subsequent minimum temperature sample having an associated pulse energy that is greater than the pulse energy associated with the maximum temperature sample;

(2) fitting a second linear regression line to temperature samples that have respective associated pulse energies greater than the pulse energy associated with the minimum temperature sample; and (3) determining a turn on pulse energy that corresponds to an intersection of the first and second linear regression line.

4. The method of claim 1 wherein the step of analyzing the temperature samples to determine a turn on pulse energy includes the steps of:

(1) fitting a temperature curve to the temperature samples; and (2) determining a turn on pulse energy that corresponds to a maximum curvature of the temperature curve in a region of the temperature curve that changes from decreasing to increasing pursuant to increasing pulse energy.

5. The method of claim 1 wherein the step of analyzing the temperature samples to determine a turn on pulse energy includes the steps of determining a turn on pulse energy that corresponds to a temperature sample having a minimum value and which has a corresponding pulse energy that is greater than a pulse energy that corresponds to a temperature sample having a maximum value.

6. A method for operating a thermal ink jet printer including a printhead having ink firing resistors responsive to pulses provided to the printhead, the pulses having a voltage, a pulse width, and a pulse energy defined by the voltage and pulse width of a pulse, comprising the steps of:

(A) applying to the printhead a sequence of pulse bursts of respective decreasing pulse energies that span a predetermined pulse energy range, each pulse burst comprised of a plurality of pulses having a pulse energy that is associated with such pulse burst and is constant for all pulses in such burst, and each burst having a sufficient number of pulses to allow the printhead to achieve a steady state operating temperature at the pulse energy of the pulse burst;

(B) sampling a steady state operating temperature of the printhead for each of the sequence of pulses bursts of different pulse energies to produce a set of temperature samples respectively associated with the decreasing pulse energies;

(C) analyzing the temperature samples to determine a turn on pulse energy from the temperature samples; and (D) operating the thermal ink jet printhead with a pulse energy that is greater than the turn on pulse energy and in a range that provides a desired print quality while avoiding premature failure of the heater resistors.

7. The method of claim 6 wherein the step of analyzing the temperature samples to determine a turn on pulse energy comprises the step of determining a turn on pulse energy that corresponds to a maximum curvature of a temperature curve fitted to the temperature samples in a region of the temperature samples that changes from decreasing to increasing pursuant to increasing pulse energy.

8. The method of claim 6 wherein the step of analyzing the temperature samples to determine a turn on pulse energy includes the steps of:

(1) fitting a first linear regression line to temperature samples that are between a maximum temperature sample having a pulse energy associated therewith and a subsequent minimum temperature sample having an associated pulse energy that is greater than the pulse energy associated with the maximum temperature sample;

(2) fitting a second linear regression line to temperature samples that have respective associated pulse energies greater than the pulse energy associated with the minimum temperature sample; and (3) determining a turn on pulse energy that corresponds to an intersection of the first and second linear regression line.

9. The method of claim 6 wherein the step of analyzing the temperature samples to determine a turn on pulse energy includes the steps of:

(1) fitting a temperature curve to the temperature samples; and (2) determining a turn on pulse energy that corresponds to a maximum curvature of the temperature curve in a region of the temperature curve that changes from decreasing to increasing pursuant to increasing pulse energy.

10. The method of claim 6 wherein the step of analyzing the temperature samples to determine a turn on pulse energy includes the steps of determining a turn on pulse energy that corresponds to a temperature sample having a minimum value and which has a corresponding pulse energy that is greater than a pulse energy that corresponds to a temperature sample having a maximum value.

* * * * *